United States Patent [19]

Akesaka

[11] Patent Number: 4,886,394

[45] Date of Patent: Dec. 12, 1989

[54] SHIELD TUNNELING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 225,084

[22] Filed: Jul. 27, 1988

[51] Int. Cl.[4] ..... F21D 9/00

[52] U.S. Cl. ..... 405/141; 299/33; 277/81 R

[58] Field of Search ..... 405/141, 143, 146, 147, 405/144; 299/33, 33.1, 39; 227/81 R

[56] References Cited

U.S. PATENT DOCUMENTS

| | | | |
|---|---|---|---|
| 2,979,348 | 4/1961 | Rosmansky | 277/81 R |
| 3,181,302 | 5/1965 | Lindsay | 405/156 |
| 3,218,110 | 11/1965 | Conner | 277/81 R |
| 3,730,283 | 5/1973 | Kostylev et al. | 175/53 |
| 3,830,545 | 8/1974 | Sugden | 299/33 |
| 4,171,848 | 10/1979 | Ono | 405/141 X |
| 4,176,985 | 12/1979 | Cherrington | 405/184 |
| 4,311,344 | 1/1982 | Akesaka | 299/33 |
| 4,406,498 | 9/1983 | Akesaka | 299/11 |
| 4,505,302 | 3/1985 | Streatfield et al. | 138/97 |
| 4,507,019 | 3/1985 | Thompson | 405/154 |
| 4,534,676 | 8/1985 | Saito | 405/184 |
| 4,553,877 | 11/1985 | Edvardsen | 405/154 |
| 4,558,906 | 12/1985 | Takamiya et al. | 299/31 |
| 4,624,605 | 11/1986 | Akesaka | 405/141 X |
| 4,630,869 | 12/1986 | Akesaka et al. | 299/33 |
| 4,634,313 | 1/1987 | Robbins | 405/184 |
| 4,648,746 | 3/1987 | Abinett | 405/184 |
| 4,655,493 | 4/1987 | Sumi | 299/33 |
| 4,674,914 | 6/1987 | Wayman et al. | 405/154 |
| 4,692,062 | 9/1987 | Akesaka | 405/141 |
| 4,732,222 | 3/1988 | Schmidt | 175/22 |

FOREIGN PATENT DOCUMENTS

| | | | |
|---|---|---|---|
| 1261364 | 2/1968 | Fed. Rep. of Germany | 277/92 |
| 60-178098 | 11/1985 | Japan . | |
| 63-5097 | 11/1988 | Japan . | |
| 2079349 | 1/1982 | United Kingdom | 405/141 |
| 2100319 | 12/1982 | United Kingdom | 405/141 |
| 2113795 | 8/1983 | United Kingdom . | |
| 2138532 | 10/1984 | United Kingdom . | |
| 2177741 | 1/1987 | United Kingdom | 405/141 |

*Primary Examiner*—Randolph A. Reese
*Assistant Examiner*—Anthony Knight
*Attorney, Agent, or Firm*—Mattern, Ware, Stoltz & Fressola

[57] ABSTRACT

A shield tunneling machine comprises a shield body, a rotor disposed in a front portion of the shield body, support is provided behind the rotor in the shield body and for supporting the rotor to be eccentrically movable around the center axis of the shield body, drive motor for moving the rotor eccentrically and a seal disposed between the support and the rotor. The seal is provided with an annular recess provided around the center axis in a portion where one of the supports and the rotor faces the other and opened to the other of the supports and the rotor, a ring disposed in the recess to be movable in the direction of the center axis and having a generally constant outer diameter and a spring for pressing the ring toward the other of the supports and the rotor. The diameter $D_1$ of the ring, the maximum diameter $D_2$ of the contact portion between the ring and the other of the supports and the rotor and the eccentrically e of the eccentric movement have the following relationship; $D_1 \leqq D_2 - 2e$.

10 Claims, 5 Drawing Sheets

SHIELD TUNNELING MACHINE

BACKGROUND OF THE INVENTION

1. Field of the Invention

This invention relates to a shield tunneling machine suited for laying pipes according to a pipe propelling engineering method.

2. Description of the Prior Art

According to a pipe propelling engineering method, a shield tunneling machine is disposed at the forefront of a plurality of pipes to be propelled. The tunnel face is excavated by the operation of a cutter head provided on the machine and simultaneously the pipe and machine are subjected to thrust produced by a propelling jack adjacent to the rearmost pipe. Therefore, the pipe and machine are propelled into the ground excavated by the operation of the cutter head. The cutter head is disposed in front of a partition wall crossing a shield body and spaced from the partition wall.

During propulsion of the machine and pipe, substances excavated from the tunnel face, i.e., muck are introduced into a pressure chamber provided between the cutter head and the partition wall, i.e., a front area of the shield body through the cutter head to fill the front area. The muck filling the front area serves to apply a face earth pressure to the partition wall of the shield body and to apply a reaction of the partition wall to the tunnel face, thus resulting in maintaining the tunnel face stable by an equilibrium between the reaction and the face earth pressure without any collapse and bulging of the tunnel face.

One of the known shield tunneling machines of this type, as disclosed in Japanese Utility Model Public Disclosure (KOKAI) No. 60-178098, Patent Publication No. 61-102999 and Utility Model Public disclosure (KOKAI) No. 63-5097, includes a rotor for crushing large gravels contained in the muck and disposed in the front area such as to facilitate a discharge of the excavated muck. In this machine, the rotor is rotated eccentrically about the center axis of the shield body by a drive mechanism so that the gravels are pressed against the inner surface of the shield body for crushing. The crushed gravels are discharged to a rear area of the shield body together with the muck by a discharging machine without reducing the pressure in the front area.

Also, in this machine, bearing sections are filled with lubricant such as to make the rotation of the rotor and that of a shaft for supporting the rotor smooth and to protect the bearing sections, and seal means are disposed between the rotor and the partition wall. The bearing sections are defined from the front area by the seal means to prevent water and muck from entering the bearing sections The prior seal means of this type comprises a mechanical seal provided with an annular recess provided in a portion of the partition wall opposed to the rotor and opened to the rotor to extend about the axis of the shield body, a ring disposed in the recess for movement in the direction of the axis of the shield body and a spring for pressing the ring toward the rotor.

However, according to the mechanical seal used in the prior shield tunneling machine, the ring is a tube having the uniform outer diameter and the diameter of a seal surface of the ring contacting the rotor is larger than that of the seal surface of the rotor contacting the ring. Therefore, along with the eccentric movement of the rotor, the seal surface of the ring is exposed to the front area. At this time, the ring may be urged into the recess against the spring force due to the pressure in the front area thereby degrading the sealing effect.

That is, the front area, particularly a space around a seal device is held at a pressure which is higher than that in the bearing section. However, according to the prior mechanical seal, when the seal surface of the ring is exposed to the front area, the pressure in the front area acts on that portion of the seal surface which is exposed to the front area. This pressure serves to draw back the ring into the recess against the spring force, since the prior mechanical seal is constructed to bring the seal surface into contact with the partition wall. Therefore, the ring is separated from the partition wall to degrade the seal effect.

On a front end of the rotor is mounted a cutter assembly provided with a plurality of cutter bits. Each cutter bit is disposed such that the cutting edge is located on the identical surface orthogonal to the rotary axis of the cutter assembly and directed radially outward from the center of the eccentric section. Also, the prior machine is provided with an internal gear fixed to the partition wall and an external gear fixed to the rotor such so as to forcibly rotate the rotor around the eccentric section of a crankshaft. Thus, the rotor and cutter assembly are turned (revolved) about the center axis of the shield body while being rotated (on their own axes) around the axis extending parallel to the center axis of the shield body. Accordingly, each cutter bit excavates the tunnel face when it is moved outward since the cutting edge is directed outward.

In such a prior art machine, however, since the cutter assembly revolves both around the shield body and on its own axis while the cutting edge of each cutter bit is directed outward, the shield body will change its orientation upward along with the excavation.

Namely, when the tunnel face is excavated by the cutter bits disposed below the rotary axis of the cutter assembly along with the turning and rotational movement of the cutter assembly, the cutter assembly is subjected to upward force. This upward force is applied to a front portion of the shield body. When the ground is soft, this force acts on the shield body so as to push up earth and sand above the shield body. As a result, a space is formed between the front lower surface of the shield body and the ground and the earth and sand around the shield body are introduced into this space to maintain the orientation of the shield body slightly upward. Thus, every time the excavation is done by the cutter bits disposed below the rotary axis of the cutter assembly, the orientation of the shield body will be changed gradually upward. Particularly, when soft ground including rocks is excavated, a large force acts on the shield body, so that the orientation of the shield body will be remarkably changed.

On the other hand, when the tunnel face is excavated by the cutter bits disposed above the rotary axis of the cutter assembly, the cutter assembly is subjected to downward force. Thus, the downward force also acts on the shield body. However, the lower surface of the shield body is only pressed against the earth and sand under the shield body due to the downward force. At this time, since a space is not formed between the lower surface of the shield body and the ground around the shield body, the orientation of the shield body will not be changed even if the ground to be excavated is soft.

SUMMARY OF THE INVENTION

An object of the present invention is to provide the shield tunneling machine, in which a pressure at the front area of a shield body does not act on a ring of seal means, thereby preventing degradation of the sealing effect.

Another object of the present invention is to provide a shield tunneling machine, in which the orientation of a shield body is not changed even if force for directing the orientation of the shield body upward acts on the shield body.

A shield tunneling machine according to the present invention comprises a shield body, a rotor disposed in a front portion of the shield body, support means provided at the rear of the rotor in the shield body and for supporting the rotor to be eccentrically movable around the center axis of the shield body, drive means for eccentrically moving the rotor and seal means disposed between the support means and the rotor, wherein the seal means is provided with an annular recess provided around the center axis of the shield body in the portion where one of the support means and rotor faces the other and opened to the other of the support means and rotor, a ring disposed in the recess to be movable in the direction of the center axis of the shield body and having a generally constant outer diameter and a spring for urging the ring toward the other of the support means and rotor, and when assuming the diameter of the ring is $D_1$, the maximum diameter of a contact portion between the other of the support means and rotor and the ring is $D_2$ and the eccentricity of the eccentric movement is e, the relation among $D_1$, $D_2$ and e is as follows;

$$D1 \leqq D2 - 2e.$$

Since the outer diameter of the ring is generally constant and the diameter of the contact surface (seal surface) of the other of the support means and rotor and the ring is represented by $$D1 \leqq D2 - 2e,$$

even if the ring of the seal means is turned around the other of the support means and rotor by the turning revolution and rotational movement of the rotor, the pressure in the front area acts only on the outer peripheral surface of the ring and the seal surface is not exposed to the front area. Thus, force rendering the ring to retreat against the spring force due to the pressure in the front area of the partition wall does not act on the ring.

In a preferred embodiment according to the present invention, the support means comprises a partition wall for dividing the interior of the shield body into a front area and a rear area located behind the front area, and the rotor is supported by a rotary shaft extending through the partition wall axially of the shield body. Also, the ring has a main body slidably received in the recess and a projection extending coaxially with the main body from the end of the main body at the side of the other of the support means and rotor toward the other of the support means and rotor. Further, in the portion where the other of the support means and rotor contacts the ring is disposed a carrier seat brought into contact with the ring.

Another shield tunneling machine according to the present invention comprises a shield body, a cutter assembly having a plurality of cutter bits and disposed in a front portion of the shield body, means for supporting the cutter assembly so that the cutter assembly is eccentrically moved around the center axis of the shield body to excavate the tunnel face with the cutter bits and drive means for moving eccentrically the cutter assembly, wherein each cutter bit is disposed so that, along with the eccentric movement of the cutter assembly, the cutter bit transmits a downward reaction to the shield body when the cutter bit is disposed below the rotary axis of the cutter assembly to excavate earth and sand while the cutter bit transmits an upward reaction to the shield body when the cutter bit is disposed above the rotary axis of the cutter assembly to excavate the earth and sand.

According to this machine, when the tunnel face is excavated by the cutter bits disposed below the rotary axis of the cutter assembly along with the turning and rotational movement of the cutter assembly, the downward force acts on the front portion of the shield body. On the contrary, when the tunnel face is excavated by the cutter bits disposed above the rotary axis of the cutter assembly, the upward force acts on the shield body.

When the downward force acts on the shield body, the lower surface of the shield body is only pressed against the earth and sand located under the shield body. At this time, any space is not formed between the lower surface of the shield body and the ground around the shield body so that the orientation of the shield body will not be changed even if the ground to be excavated is soft.

Further, when the upward force acts on the shield body, the tunnel face is scraped down toward an excavated space by the cutter bits. Accordingly, the softer the ground to be excavated is, the smaller the upward force acting on the shield body is and thus any space is not formed below the shield body. As a result, the orientation of the shield body will not be changed. When the ground to be excavated is hard, the shield body is blocked from changing the orientation thereof due to the hard ground.

Each cutter bit may be disposed to have the cutting edge directed toward the rotary axis of the cutter assembly. Also, respective cutter bits other than the cutter bit disposed at the rotary center of the cutter assembly may be disposed such that the cutting edges thereof are located on the identical surface orthogonal to the center axis of the cutter assembly, or the cutting edges are located in front of the cutting edge of the cutter bit disposed at the rotary centerside position relative to the positions of the cutter bits.

In a preferred embodiment according to the present invention, the support means comprises a partition wall dividing the interior of the shield body into a front area and a rear area located behind the front area. In this case, the drive means comprises a crankshaft extending through the partition wall in the axial direction of the shield body, a rotor supported rotatably by the eccentric section of the crankshaft in the front area of the shield body, a gear mechanism provided with an internal gear fixed to one of the shield body or the partition wall and rotor and an external gear fixed to the other shield body or the partition wall and rotor and a drive mechanism for rotating the crankshaft. The cutter assembly is mounted on the front end of the rotor. Thus, the cutter assembly is turned around the rotary axis of the crankshaft along with the rotation of the crankshaft and simultaneously rotated around the eccentric section.

BRIEF DESCRIPTION OF THE DRAWINGS

The foregoing and other objects and features of the invention will become apparent from the following description of a preferred embodiment of the invention with reference to the accompanying drawings, in which.

DESCRIPTION OF THE PREFERRED EMBODIMENT

A shield tunneling machine 10 shown in FIGS. 1 to 5 comprises a tubular shield body 12 provided with first and second bodies 14, 16 butting against each other.

Figure 1:
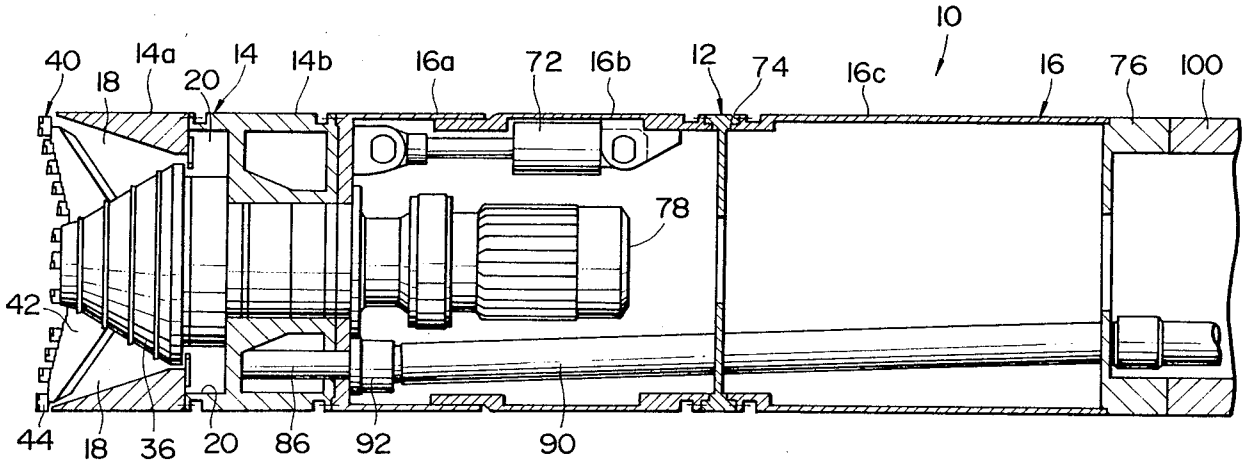
FIG. 1 is a sectional view showing an embodiment of a shield body of a shield tunneling machine according to the present invention.
Figure 2:
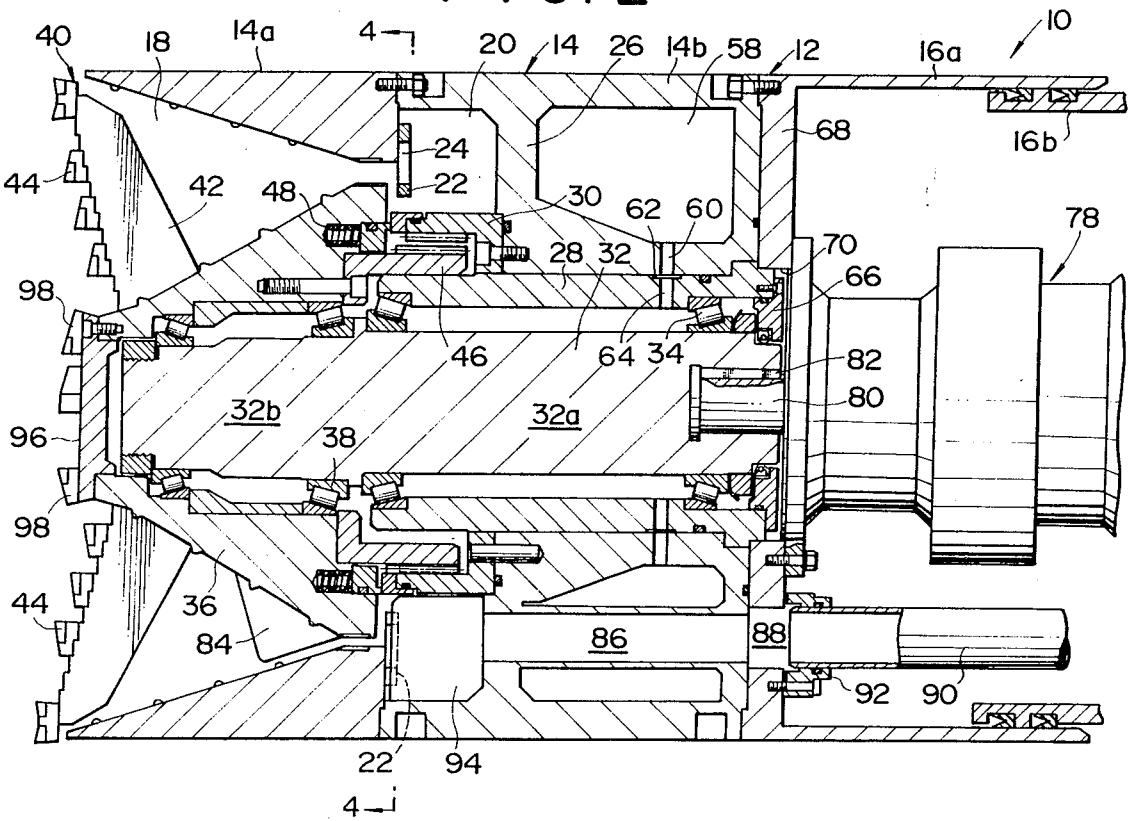
FIG. 2 is an enlarged sectional view showing the machine in FIG. 1.

As shown in FIGS. 1 and 2, the first body 14 is provided with a first tubular portion 14*a* defining a conical muck crushing chamber having a bore gradually along with the eccentric movement of the cutter assembly converging rearward, i.e., a first space 18 and a second tubular portion 14*b* defining a muddy water chamber following a rear portion of the first space 18 and having a sectional area wider than that of the first space, i.e., a second space 20. The first and second tubular portions 14*a*, 14*b* are separably butted against each other for coupling with each other on the rear end of the first tubular portion 14*a* and the front end of the second tubular portion 14*b* by a plurality of bolts. The first space 18 may have a bore of approximately uniform cross sectional area.

As shown in FIG. 2, grooves extending in the circumferential direction are formed on the outer peripheries of front and rear ends of a second tubular portion 14*b*. In the front end of the second tubular portion 14*b* is connected with the rear end of the first tubular portion 14*a* by a plurality of bolts for separably interconnecting the first and second tubular portion 14*a*, 14*b*. A plurality of bolts for separably interconnecting the first and second bodies 14, 16 are disposed in a flange portion formed on the outer periphery of the rear end of the second tubular portion 14*b* by the groove formed in the rear end of the second tubular portion 14*b*.

Figure 4:
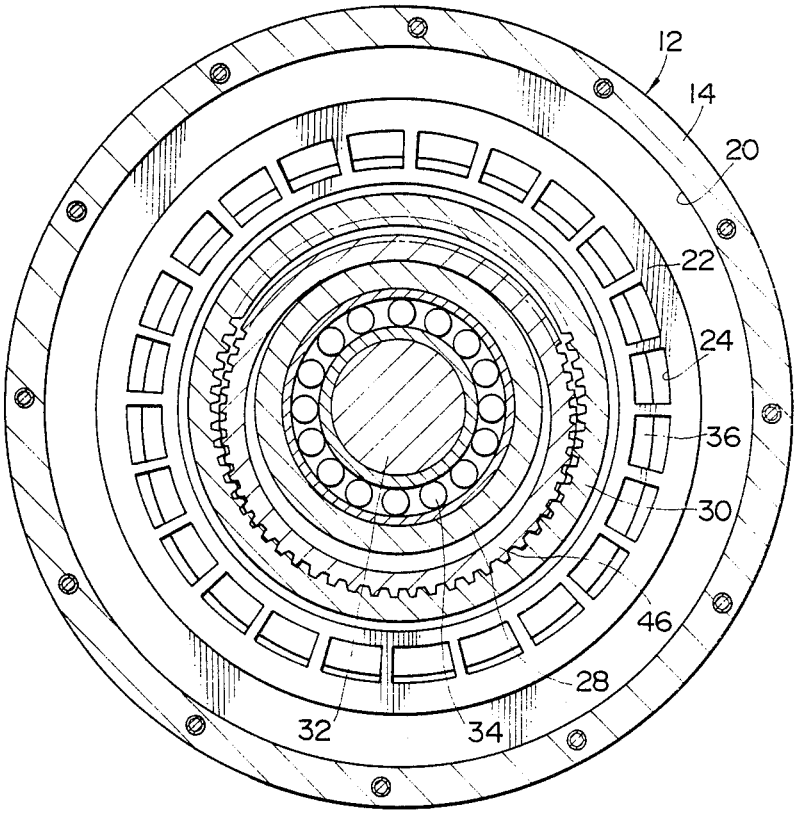
FIG. 4 is a sectional view taken along the line 4—4 in FIG. 2.

As shown in FIGS. 2 and 4, the first tubular portion 14*a* is provided at the inside of the rear end with an inward annular grating 22 dividing the interior of the first body 14 into the first and second spaces 18,20. The grating 22 extends along the rear end face of the first tubular portion 14*a* and has a plurality of openings 24 disposed at uniform angular intervals around the axis of the shield body 12 in such manner that small excavated substances are allowed to move from the first space 18 to the second space 20 while large excavated substances are blocked from moving from the first space 18 to the second space 20. The grating 22 may be mounted on the inside of the front end of the second tubular portion 14*b*. The second tubular portion 14*b* is provided with a partition wall 26 dividing the interior of the shield body 12 into a front area and a rear area.

As shown in FIGS. 2 and 4, the partition wall 26 supports unslidably and unrotatably a tubular sleeve 28 extending through the partition wall 26 axially of the shield body 12. To the first tubular portion 14*a*-side of the partition wall 26 is fixed an internal gear 30 extending around the sleeve 28 by a plurality of bolts. The sleeve 28 supports rotatably a crankshaft 32 extending through the sleeve 28 axially of the shield body 12 with a plurality of bearings 34. The crankshaft 32 is provided with a shaft portion 32*a* supported by the sleeve 28 and an eccentric portion i.e., a shaft portion 32*b* extending from the shaft portion 32*a* forward. The L axis of the shaft portion 32*a* coincides with the axis of the shield body 12. On the other hand, the axis of the shaft portion 32*b* is spaced by eccentricity e from the axes of the shield body 12 and shaft portion 32*a* and is disposed in the first space 18.

As shown in FIG. 2, the shaft portion 32*b* supports rotatably a rotor 36 constituting a crusher together with the first tubular portion 14*a* through a plurality of bearings 38. The rotor 36 has a conical shape having the outer surface successively diverging toward the rear end side and is disposed in the first space 18. A gap between the rear outer end face of the rotor 36 and the rear inner end face of the first tubular portion 14*a* is smaller than the dimension of the opening 24 of the grating 22 in the diametrical direction of the shield body 12. Further, a plurality of projections or grooves may be provided circumferentially on the inner surface of the first tubular portion 14*a* and the outer surface of the rotor 36 defining the first space 18.

Figure 3:
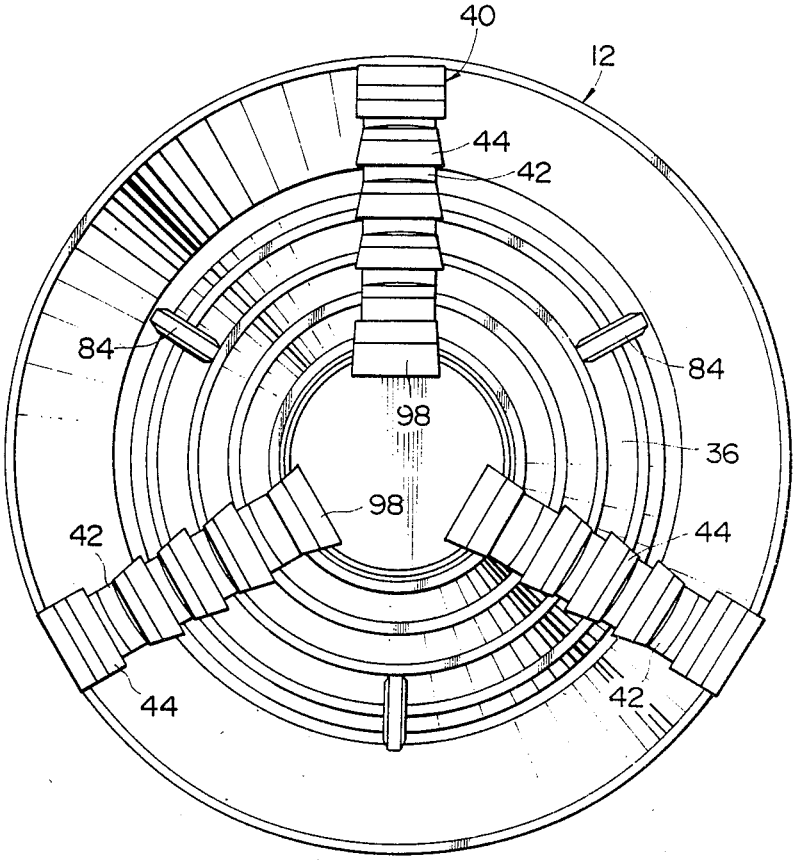
FIG. 3 is a left side view showing the machine in FIG. 2.

As shown in FIGS. 1 and 3, a cutter assembly 40 is fixed to the front end of the rotor 36. The cutter assembly 40 is provided with a plurality of arms 42 extending radially of the shield body 12 from the rotor 36 and a plurality of cutter bits 44 respectively fixed to the arms 42. Each cutter bit disposed at the foremost end of the arm 42 has an inward cutting edge directed toward the rotary center of the cutter assembly 40 and an outward cutting edge directed in the reverse direction. On the contrary, the other cutter bits are disposed to have their cutting edges directed toward the rotary center of the cutter assembly 40, i.e., directed inward, and simultaneously to arrange the inward cutting edge to be located behind the cutting edge of the cutter bit disposed at the outside of the cutter bit having the aforementioned inward cutting edge. Further, the cutting edge of each cutter bit may be disposed on the identical surface orthogonal to the rotary axis of the cutter assembly 40.

As shown in FIGS. 2 and 4, an external gear 46 meshing with the internal gear 30 is fixed to the rear end face of the rotor 36 by a plurality of bolts. The gear 46 is spaced eccentrically from the gear 30 by a distance e equal to the eccentricity of the shaft portion 32*b* with respect to the shaft portion 32*a* of the crankshaft 32. Thus, the gears 30,46 mesh with each other on one diametrical position. The meshing position of both gears moves around the sleeve 28 along with the rotation of the crankshaft 32. As a result, the rotor 36 and cutter assembly 40 turn (revolve) around the axis of the shield body 12 while rotating (around their own axes) around the shaft portion 32*b*.

Figure 5:
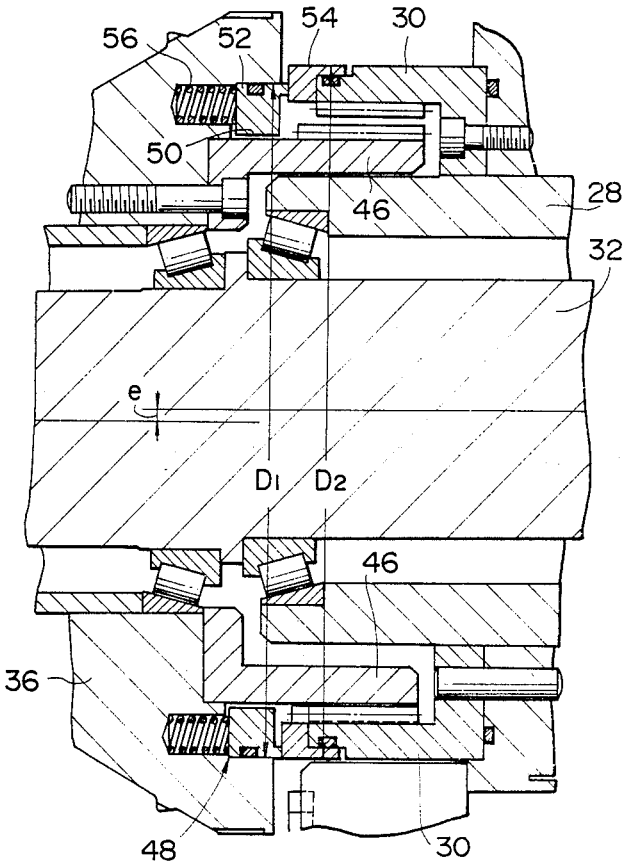
FIG. 5 is an enlarged sectional view showing a portion of a mechanical seal.

As shown in FIGS. 2 and 5, an annular mechanical seal 48 is disposed between the rotor 36 and the internal gear 30 to provide a liquid tight seal therebetween. The mechanical seal 48 includes an annular groove, i.e., a recess 50 provided on the rear end face of the rotor 36 and coaxial with the rotor 36, a tubular ring 52 fitted in the recess and having the identical outer diameter dimension, an annular carrier seat 54 fixed to the front end face of the internal gear 30 and coaxial with the internal gear and a plurality of springs 56 for pressing the ring 52 against the carrier seat 54. The recess 50 is opened to the internal gear 30.

The ring 52 is provided with an annular main body received slidably in the recess 50 in the axial direction of the shield body 12 and a projection extending from the outer periphery of the rear end of the main body rearward and coaxial with the main body. The main body and projection of the ring 52 have the uniform outer diameters and are located coaxially with the rotor 36, i.e., spaced eccentrically from the internal gear 30 by the distance e. The spring 56 comprises a compression spring and is disposed in a hole communicating to the recess 50.

The respective outer diameters of the main body and projection of the ring 52, particularly the diameters of the rear end face of the ring 52 and the front end face of the carrier seat 54, i.e., the contact surface (seal surface) between the ring 52 and the carrier seat 54 are smaller than the outer diameter of the carrier seat 54 by a value 2e. Namely, the diameter of the contact surface (seal surface) between the ring 52 and the carrier seat 54 is represented as follows;

$$D1 \leqq D2 - 2e$$

assuming that the diameter of the outer periphery of the rear end face (projection) of the ring 52 is $D_1$ and the diameter of the outer periphery of the front end face of the carrier seat 54 is $D_2$.

As shown in FIG. 2, the partition wall 26 has an annular oil chamber 58 surrounding the sleeve 28, and lubricant is received in the oil chamber 58. The oil chamber 58 communicates to a space formed between the crankshaft 32 and the sleeve 28 through a plurality of holes 60 bored in the partition wall 26, an annular recess 62 formed on the outer periphery of the sleeve 28 and a plurality of holes 64 bored in the sleeve 28. Thus, the space between the crankshaft 32 and the sleeve 28 and the gap between the partition wall 26 and the sleeve 28 are filled with the lubricant.

Sealing 0-rings are respectively disposed in the contact portion between the front end of the rotor 36 and the front end of the crankshaft 32, contact portion between the rotor 36 and the ring 52, contact portion between the partition wall 26 and the internal gear 30 and contact portion between the sleeve 28 and the partition wall 26. Also, a seal material 66 adapted to preventing the lubricant from outflowing is disposed between the rear end of the sleeve 28 and the rear end of the crankshaft 32. The seal material 66 is fixed to the sleeve 28 by a plurality of bolts.

As shown FIGS. 1 and 2, the second body 16 is provided with the first tubular portion **16*a* connected with the rear end of the second tubular portion 14*b*, the second tubular portion 16*b* inserted into the rear end of the first tubular portion 16*a* and a third tubular portion 16*c* connected with the rear end of the second tubular portion 16*b*. The first tubular portion 16*a* is provided on the front end with a support wall 68 which is at a right angle to the axis of the shield body 12, and the support wall is provided with a hole 70 for receiving the rear end of the sleeve 28. The first tubular portion 16*a* and second tubular portion 16*b* of the second body 16 are interconnected by a plurality of jacks 72 adapted for correcting the direction. Connectors 74,76 are respectively disposed between the second tubular portion 16*b* and the third tubular portion 16*c* and between the third tubular portion 16*c* and a pipe 100** to be laid.

To the rear of the support wall 68 is fixed a drive mechanism 78 for rotating the crankshaft 32 by a plurality of bolts. The drive mechanism 78 is provided with a motor and reduction gears. An output shaft 80 of the drive mechanism 78 is inserted into a hole bored in the rear end of the crankshaft 32. The output shaft 80 is unrotatably coupled with the crankshaft 32 by a key 82.

As shown in FIGS. 1 and 2, on the outer conical surface of the rotor 36 are mounted a plurality of blades 84 for stirring the excavated substances in the first space 18 along with the rotation of the rotor 36 to give fluidity to the excavated substances.

The partition wall 26 and support wall 68 are respectively provided with muddy water supply paths 86,88 for supplying muddy water from the rear of the machine 10 to the second space 20 and a muddy water drain path (not shown) for draining the muddy water supplied to the second space 20 to the rear of the machine 10 together with the excavated substances. On the support wall 68 is mounted a pipe 90 for guiding the muddy water to the supply path 88 by a mounting tool 92. Also, on the support wall 68 is mounted a pipe (not shown) for guiding the muddy water from the muddy water draining path to the rear of the machine 10 by a mounting tool (not shown).

As shown in FIG. 2, on the bottom of the second space 20 is provided a partition 94 for preventing the muddy water supplied from the muddy water supply path 86 from directly reaching the muddy water draining path and defining a muddy water flow path in the second space 20 in order to flow the muddy water through flow paths in the second space 20.

As shown in FIGS. 1, 2 and 3, a disk-like cap 96 is mounted on the front end of the rotor 36 by a plurality of screws. A plurality of cutter bits 98 for excavating the center of the face are fixed to the cap 96. The cutting edge of each cutter bit 98 is directed toward the rotary axis of the rotor 36.

When excavation is done, the drive mechanism 78 of the machine 10 is operated to rotate the crankshaft 32. Thus, the rotor 36 and cutter assembly 40 are turned (revolved) with the eccentricity e to the axis of the shield body 12 around the crankshaft 32 in the same rotational direction as the crankshaft 32. Since the position in which the external gear 46 fixed to the rotor 36 meshes with the internal gear 30 fixed to the partition wall 26, is displaced sequentially along with the turning movement of the rotor 36, the rotor 36 and cutter assembly 40 are also rotated (about their own axes) around the shaft portion **32*b* in the opposite rotational direction to that of the crankshaft 32**.

According to the turning and rotational movement of the rotor 36 and cutter assembly 40, the cutting bits 44,98 are not only turned and rotated relative to the shield body 12 together with the cutter assembly 40, but also are reciprocated toward the center of the shield body 12, so-called inward and reversely outward, i.e, in the outwardly radial direction of the shield body 12 relative to the shield body 12.

The machine 10 under such state that the cutter assembly 40 is turned and rotated as mentioned above, is subjected to thrust through a pipe 100 by a propelling mechanism (not shown) disposed behind the machine 10. Thus, the machine 10 is advanced while excavating the tunnel face with the cutter assembly 40 and the pipe 100 is pushed into the excavated hole.

Since the cutting edge of each cutter bit 44 is directed inward and the cutter bit 44 reciprocates radially of the shield body 12 relative to the shield body, the cutter bit 44 excavates the tunnel face when it moves in the direction of the rotary axis, i.e., inward relative to the shield body 12. However, the cutter bit 44 does not excavate the tunnel face when it moves in the opposite direction to that of the rotary axis.

Accordingly, when the tunnel face is excavated by the cutter bits 44 disposed below the rotary axis of the cutter assembly 40 along with the turning and rotational movement of the cutter assembly 40, the downward force is applied to the front portion of the shield body 12, whereas the shield body 12 is subjected to the upward force when the tunnel face is excavated by the cutter bits 44 disposed above the rotary axis of the cutter assembly.

When the upward force acts on the shield body 12, the cutter bits 44 will scrape down the face into an excavated space, so that the softer and weaker the ground to be excavated is, the smaller the upward force acting on the shield body 12. Thus, any space is not formed below the shield body 12. Therefore, the orientation of the shield body 12 is not changed. When the ground to be excavated is hard, the shield body 12 is blocked from changing the orientation thereof by the hard ground.

When the downward force acts on the shield body 12, the lower surface of the shield body 12 is only pressed against the earth and sand located under the shield body 12. Since any space is not formed between the lower surface of the shield body 12 and the ground around the shield body, the orientation of the shield body 12 will not be changed even if the ground to be excavated is soft. Particularly, the gravels which existed above the tunnel face are gathered below the tunnel face and large downward force acts on the shield body 12 when the gravels are excavated. However, the orientation of the shield body 12 is not changed by the downward force.

Excavated earth and sand, i.e., substances are received in the first space 18. The excavated substances received in the first space 18 are stirred by the blades 84 along with the rotation of the rotor 36, and simultaneously flow from the first space 18 through the openings 24 in the grating 22 to the second space 20. The excavated substances flowing into the second chamber 40 are mixed with muddy water supplied into the second chamber 40 and the mixture, i.e., slurry is discharged by the discharge mechanism 26 to the rear of the machine 10.

Along with the turning and rotational movement of the rotor 36, large gravels contained in the excavated substances received in the first space 18 are pressed against the inner surface defining the first space 18 of the shield body 12 by the rotor 36 and are crushed into small pieces capable of passing through the openings 24. The small pieces crushed enough to pass through the openings 24 are received in the second space 20 through the openings 24. Therefore, the discharging pipe does not clog up with the gravels.

The first and second spaces 18,20 are maintained at such a predetermined pressure as will prevent the tunnel face and ground from collapsing and bulging respectively during the excavation. However, the pressure in the second space 20 will not act on the ring 52 as force rendering the ring 52 of the mechanical seal 48 to retreat against the force of the spring 56. Namely, even if the ring 52 of the mechanical seal 48 is pressed toward the carrier seat 54 by the turning and rotational movement of the rotor 36 while turning around the carrier seat 54, the rear end face of the ring 52 is always brought into contact with the front end face of the carrier seat 54 without being exposed to the second space 20, since the outer diameter of the ring 52 is generally constant and the diameter of the contact surface (seal surface) between the ring 52 and the carrier seat 54 is represented as follows;

$$D1 \leqq D2 - 2e$$

Accordingly, the pressure in the front area of the partition wall only acts on the outer peripheral surface of the ring and the force caused by the pressure in the second space 20 does not act on the rear end face of the ring 52. As a result, liquid tightness may be maintained between the ring 52 and the carrier seal 54.

What is claimed is:

1. A shield tunneling machine comprising;

a shield body;

a rotor disposed in a front portion of the shield body;

support means provided behind said rotor in said shield body and for supporting said rotor so as to be eccentrically rotatable around the center axis of said shield body;

drive means for moving said rotor eccentrically; and seal means disposed between said support means and said rotor;

wherein said seal means has an annual recess provided around said center axis in a position where one of said support means and rotor faces the other of said support means and said rotor and opened to the other of said support means and said rotor, a ring disposed in the recess so as to be movable in the direction of said center axis and having an approximately constant outer diameter and a spring for pressing the ring toward the other of said support means and said rotor;

the other of said support means and said rotor having an annular contact portion to contact with the whole end face of said ring; and the diameter $D_1$ of said ring, the diameter $D_2$ of said contact portion, and the distance between the center of said ring and the center of said contact portion e having the following relationship:

$$D1 \leqq D2 - 2e.$$

2. A shield tunneling machine as claimed in claim 1, wherein said support means comprises a partition wall dividing the interior of said shield body into a front area and a rear area located behind said front area and said rotor is supported by a rotary shaft extending through said partition wall axially of said shield body.

3. A shield tunneling machine as claimed in claim 1, wherein said ring has a main body received slidably in said recess and a projection extending coaxially with said main body from an end of said main body at the side of the other of said support means and said rotor to said other of said support means and said rotor.

4. A shield tunneling machine as claimed in claim 1, wherein a carrier seat brought into contact with said ring is disposed on the contact portion between said ring and the other of said support means and said rotor.

5. A shield tunneling machine comprising:

a shield body;

a cutter assembly having a plurality of cutter bits and disposed in a front portion of said shield body;

means for supporting the cutter assembly such that the cutter assembly is moved eccentrically around the center axis of said shield body to excavate the tunnel face with said cutter bits; and drive means for moving eccentrically said cutter assembly;

wherein each cutter bit is disposed such that, along with the eccentric movement of said cutter assembly, the cutter bit transmits a downward reaction to said shield body when said cutter bit is displaced below the rotary axis of said cutter assembly to excavate earth and sand, while the cutter bit transmits an upward reaction to said shield body when said cutter bit is displaced above said rotary axis of said cutter assembly to excavate the sand and earth.

6. A shield tunneling machine as claimed in claim 5, wherein each cutter bit has a cutting edge directed toward the rotary axis of said cutter assembly.

7. A shield tunneling machine as claimed in claim 6, wherein each cutter bit other than the cutter bit disposed in the rotary center of said cutter assembly has the cutting edge located on the identical surface orthogonal to said center axis or disposed in front of the cutting edge of the cutter bit disposed in said rotary center-side position relative to the first-mentioned cutter bit.

8. A shield tunneling machine adapted for an existing pipeline as claimed in claim 5, wherein said support means comprises a partition wall dividing the interior of said shield body into the front area and the rear area located behind the front area and said drive means comprises a crankshaft extending through said partition wall axially of said shield body, a rotor supported rotatably by said eccentric portion of said crankshaft in said front area of said shield body, a gear mechanism provided with an internal gear fixed to one of said shield body or said partition wall and said rotor and an external gear fixed to the other of said shield body or said partition wall and said rotor and a drive mechanism for rotating said crankshaft, said cutter assembly being mounted on the front end of said rotor so that said cutter assembly is turned around the rotary axis of said crankshaft along with the rotation of said crankshaft while being rotated around said eccentric portion.

9. A shield tunneling machine comprising;

a shield body;

a rotor disposed in a front portion of the shield body;

support means provided behind said rotor in said shield body and for supporting said rotor so as to be eccentrically movable around the center axis of said shield body;

a cutter assembly having a plurality of cutter bits and disposed in the front portion of said shield body, said cutter assembly being eccentrically moved together with said rotor for excavating the tunnel face with said cutter bits;

drive means for moving eccentrically said cutter assembly and said rotor; and seal means disposed between said support means and said rotor;

wherein said seal means is provided with an annular recess provided around said center axis in a portion where one of said support means and said rotor faces the other of said support means and said rotor and opened to the other of said support means and said rotor, a ring disposed in the recess so as to be movable in the direction of said center axis and having a generally constant outer diameter and a spring for pressing the ring toward the other of said support means and said rotor;

the diameter $D_1$ of said ring, the maximum diameter $D_2$ of the contact portion between said ring and the other of said support means and said rotor and the eccentricity e of said eccentric movement have the following relationship;

$$D1 \leqq D2 - 2e; \text{ and}$$

each cutter bit is disposed such that, along with the turning and rotation of said cutter assembly, the cutter bit transmits a downward reaction to said shield body when said cutter bit is displaced below the rotary axis of said cutter assembly for excavating earth and sand while said cutter bit transmits an upward reaction to said shield body when said cutter bit is displaced above said rotary axis for excavating the earth and sand.

10. A shield tunneling machine comprising:

a shield body;

a partition wall dividing the interior of the shield body into a front area and a rear area located behind said front area;

a crankshaft having an eccentric portion located in said front area and supported rotatably by said partition wall;

a rotor supported rotatably by said eccentric portion of said crankshaft in said front area;

a gear mechanism provided with an internal gear fixed to one of said shield body or said partition wall and said rotor and an external gear fixed to the other of said shield body or said partition wall and said rotor.

a drive mechanism for rotating said crankshaft so as to move eccentrically said rotor;

a cutter assembly having a plurality of cutter bits and disposed in the front portion of said shield body, said cutter assembly being supported by said rotor so as to be moved eccentrically together with said rotor for excavating the tunnel face with said cutter bits; and seal means disposed between said support means and said rotor;

wherein said seal means is provided with an annular recess provided around said center axis in a portion where one of said support means and said rotor faces the other of said support means and said rotor and opened to the other of said support means and said rotor, a ring disposed in the recess so as to be movable in the direction of said center axis and having a generally constant outer diameter and a spring for pressing the ring toward the other of said support means and said rotor;

the diameter $D_1$ of said ring, the maximum diameter $D_2$ of the contact portion between said ring and the other of said support means and said rotor and the eccentricity e of said eccentric movement have the following relationship;

$$D1 \leqq D2 - 2e; \text{ and}$$

each cutter bit is disposed so that, along with the turning and rotation of said cutter assembly, said cutter bit transmits a downward reaction to said shield body assembly when said cutter bit is displaced below the rotary axis of the cutter assembly for excavating earth and said while said cutter bit transmits an upward reaction to said shield body when said cutter bit is displaced above said rotary axis for excavating the earth and sand.

* * * * *

UNITED STATES PATENT AND TRADEMARK OFFICE

CERTIFICATE OF CORRECTION

PATENT NO. : 4,886,394

DATED : December 12, 1989

INVENTOR(S) : Toshio Akesaka

It is certified that error appears in the above—identified patent and that said Letters Patent is hereby corrected as shown below:

Abstract, lines 18-19, "eccentrically" has been changed to --eccentricity--.
Column 1, line 35, "Publication" has been changed to --Public Disclosure (KOKAI)--.
Column 1, line 39, "such" has been changed to --so--.
Column 1, line 48, "such" has been changed to --so--.
Column 2, line 16, "a" first occurrence has been changed to --the--.
Column 2, line 23, "such" has been deleted.

Column 4, line 64, after "other", --of the-- has been added.
Column 5, lines 30-31, "along with the eccentric movement of the cutter assembly" has been deleted.
Column 6, line 14, "L" has been deleted.
Column 7, line 8, after "30", --- side-- has been added.
Column 7, lines 52-53, "preventing" has been changed to --prevent--.
Column 7, line 53, "outflowing" has been changed to --overflowing--.
Column 9, line 39, "existed" has been changed to --exist--.

Signed and Sealed this

Twelfth Day of February, 1991

*Attest:*

HARRY F. MANBECK, JR.

*Attesting Officer*

*Commissioner of Patents and Trademarks*